United States Patent [19]

Van Scyoc et al.

[11] Patent Number: 4,983,133

[45] Date of Patent: Jan. 8, 1991

[54] ELECTRICAL TERMINAL WITH ANNULAR SECTION

[76] Inventors: William C. Van Scyoc, 600 Charles St., Shippensburg, Pa. 17257; James H. Wise, 607 Cambridge Ct., Palmyra, Pa. 17078

[21] Appl. No.: 359,240

[22] Filed: May 31, 1989

[51] Int. Cl.[5] ..... H01R 4/48

[52] U.S. Cl. ..... 439/860; 439/883

[58] Field of Search ..... 439/860, 868, 883, 877

[56] References Cited

U.S. PATENT DOCUMENTS

| | | | |
|---|---|---|---|
| 90,584 | 8/1833 | Koch, Jr. | 439/883 |
| 955,747 | 4/1910 | Borcy | 439/860 |
| 1,874,593 | 8/1932 | Olsen | 439/883 |
| 3,259,874 | 7/1966 | Esser | 439/883 |
| 3,569,919 | 7/1969 | Daddona, Jr. | 339/258 |
| 4,062,609 | 12/1977 | Malcolm | 439/860 |
| 4,794,056 | 12/1988 | Pedicini | 439/883 |

FOREIGN PATENT DOCUMENTS 2217822 of 0000 France .

OTHER PUBLICATIONS

Copy of Brookstone Catalog, pp. T162-B1 and 53.

*Primary Examiner*—Paula A. Bradley

[57] ABSTRACT

An electrical terminal member 10 adapted to reduce resistance at a contact interface between two electrical articles comprises first and second connecting portions 12,48 respectively. First portion 12 has an annular section 14 having a fastener receiving aperture 16 extending therethrough, an inner edge 22 adjacent the fastener receiving aperture 16 and an outer edge 28 extending circumferentially around the annular section 14. Annular section 14 further includes a plurality of slots 26 spaced therearound, the slots 26 defining therebetween respective spring sections 32 in an annular array. Each spring section includes respective protrusion 34 extending from a major surface thereof, each protrusion 34 having a crest portion 36. Crest portions 36 are disposed substantially in a common plane and define a contact interface for electrical engagement with a common conductive surface 38 of the first electrical article 60. An opposed major surface as an array of surface portions engageable by means securing first portion 12 of terminal member 10 to a said first electrical article 60. A plurality of electrical paths in parallel are established between the first and second electrical articles upon terminal 10 being connected to first and second electrical articles thereby minimizing the electrical resistance at the contact interface.

15 Claims, 3 Drawing Sheets

Fig. 4
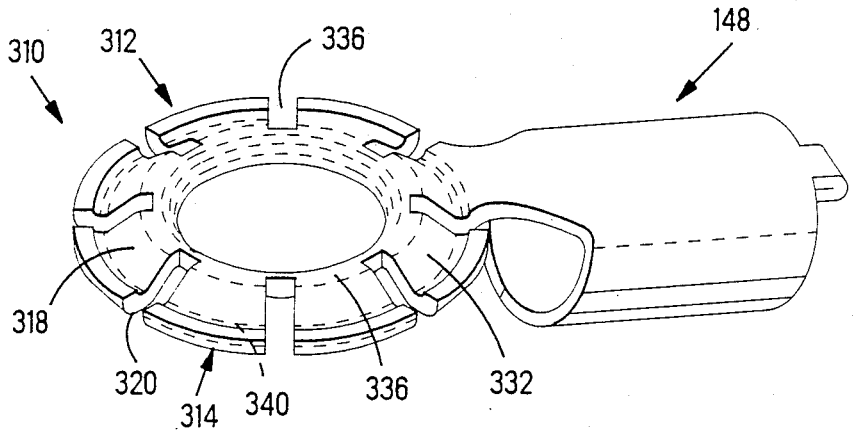
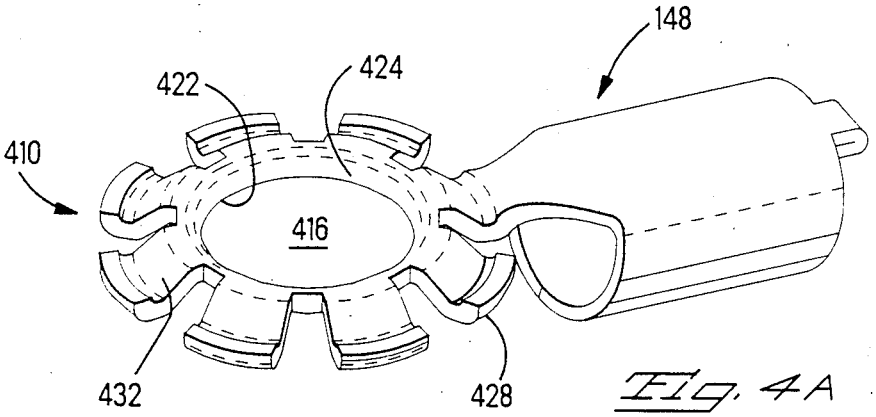
Fig. 4A
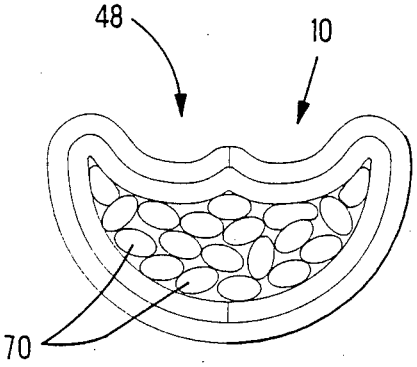
Fig. 7

ELECTRICAL TERMINAL WITH ANNULAR SECTION

FIELD OF THE INVENTION

This invention is directed to electrical contact terminals and in particular to electrical terminals having a ring-type portion.

BACKGROUND OF THE INVENTION

This application is related to U.S. patent application Ser. No. 07/359,188 filed concomitantly herewith entitled "Annular Electrical Terminal".

Generally ring tongue terminals are used to interconnect a wire conductor member to an essentially flat current conducting member by means of a bolted joint wherein torque is applied to the joint until a sufficiently low resistance results. The ring tongue terminal includes an essentially flat mating surface that engages a flat surface of an article such as a bus bar or a printed circuit board.

To ensure a low interface resistance between the ring terminal and the flat member it is necessary to apply a considerable force to the joint until a sufficiently low resistance results. The amount of torque required depends upon the electrical system in which the terminal is being used. While a high mating torque may be applied to metal conductive members such as a bus bar, the same amount of force when applied to a ring terminal bolted to a circuit board may cause distortion of the circuit board. It is desirable therefore to have a terminal with a low interface resistance that does not require a large amount of force applied between the ring terminal member and the electrical article to which it is connected.

The area of electrical engagement of the ring terminals of the prior art typically provide a single "circular line" of contact between the surface of the terminal and the electrical article to which it is attached. In actuality this "circular line" consists of a plurality of randomly located points in physical engagement and electrical contact between the corresponding surfaces. The number of points along this "line" contact depends upon the amount of force applied between the two members, the surface finish and the flatness of the surface of the two members. It is desirable, therefore, to provide as many controlled parallel current paths as possible for the current to flow between the interconnected members.

The resistance between the mated surfaces is typically controlled by applying more force to increase the uniformity and width of the contact line or number of points in actual physical and electrical engagement between the members. The amount of force required at any one interconnection is generally determined by measuring the resistance after the interconnection is made and adjusting the force as necessary to achieve the desired results. It is desirable, therefore, to have a means whereby the amount of force required and the resistance of the interface may be calculated and predetermined before the interconnection is made.

SUMMARY OF THE INVENTION

Accordingly, to alleviate the disadvantages and deficiency of the prior art, the present invention is directed to an electrical terminal having means that provides a plurality of electrical contact paths in parallel for electrical engagement with a common conductive surface of a first electrical article upon being fastened thereto.

With the foregoing in mind, it is the object of the present invention to provide an electrical terminal for electrically connecting the first electrical article to a second electrical article that overcomes the deficiencies and difficulties heretofore encountered.

It is an object of the present invention to provide multiple contact points at regular intervals along the interface between the terminal and the first electrical article and a second electrical article attached thereto.

It is a further object of the present invention to provide a means whereby the normal force required to effect electrical interconnection may be predetermined.

It is another object of the present invention to provide a ring terminal wherein the interface resistance between the ring member and the electrical article attached thereto is minimized and is essentially unaffected by surface imperfections.

It is an object of the invention to provide a calculable contact resistance of the mating interface between two electrical articles.

It is a further object to provide an electrical terminal having a controlled interface resistance suitable for use with electrical systems for carrying power or for carrying signals.

An additional object of the invention is to provide an electrical terminal having a controllable contact resistance that requires less normal force than equivalent terminals.

Accordingly the present invention provides an improved electrical terminal suitable for use for connecting first and second electrical articles comprising first and second connecting portions at opposed ends at the terminal member. The first connecting portion provides a plurality of electrical paths in parallel thereby minimizing the electrical resistance of the contact interface between first and second electrical articles upon the terminal being connected therebetween. The first connecting portion comprises an annular section having a centrally disposed fastener receiving aperture extending therethrough from a first major surface to an opposed second major surface, the annular section having an inner edge adjacent to the fastener receiving aperture and an outer edge extending circumferentially therearound.

The annular section further includes a plurality of slots spaced therearound, each extending from at least one integral strap section along one of the inner and the outer edges. The slots define respective spring sections therebetween, each of the spring sections having a respective protrusion extending outwardly from one of the major surfaces. Each respective protrusion further includes a crest portion, all of the respective crest portions being disposed substantially in a common plane for electrical engagement with a common conductive surface of a first electrical article upon being fastened thereto by fastening means. In the presently preferred embodiment the slots divide the annular member into essentially a plurality of compliant beam contact members. In one preferred embodiment and one alternative embodiment, the compliant beam members extend radially outwardly from the fastener receiving aperture. In other alternative embodiments the compliant beam members extend at a selected angle for a distance around the circumference of the angular section.

The present invention is further directed to an electrical assembly using an electrical terminal having a connecting portion that provides a controllable interface resistance.

The invention itself, together with further objects and its intended advantages, will be best understood by reference to the following detailed description taken in conjunction with the following drawings.

BRIEF DESCRIPTION OF THE DRAWINGS

FIGS. 4 and 4A are perspective views of other alternative embodiments of an electrical terminal made in accordance with this invention.

FIG. 7 is a fragmentary cross section view illustrating a conductor terminated in the double barrel portion of the terminal of FIG. 1.

DETAILED DESCRIPTION OF THE DRAWINGS

Figure 5:
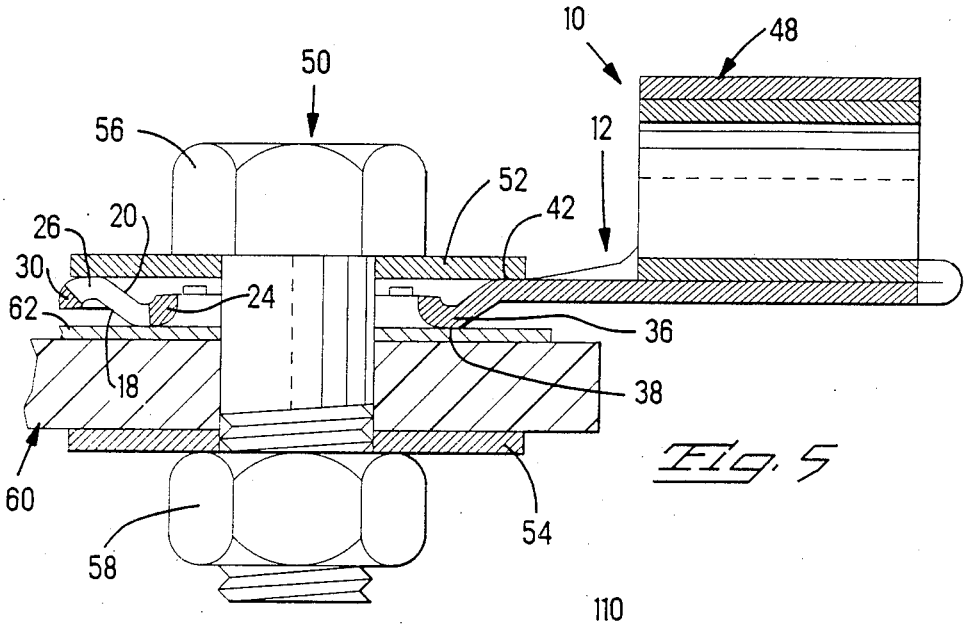
FIG. 5 is a fragmentary cross sectional view of the terminal of FIG. 1 mounted to a first electrical article.

Referring now to FIGS. 5 and 7, electrical terminal member 10 comprises a first connecting portion 12 and a second connecting portion 48 at opposed ends thereof for electrically engaging respectively a first electrical article 60 and a second electrical article shown as conductor wire 70 in FIG. 7. First connecting portion 12 comprises an annular section 14 having a centrally disposed fastener receiving aperture 16 extending therethrough from a first major surface 18 to an opposed second major surface 20. Annular section 14 has an inner edge 22 adjacent to fastener receiving aperture 16 and an outer edge 28 extending circumferentially around annular section 14. Annular section 14 further includes a plurality of slots 26 extending between first integral strap section 24 along the inner edge 22 and a second integral strap section 30 along the outer edge 28. The slots 26 define respective spring sections 32 therebetween. Each spring section 32 has a respective protrusion 34 extending outwardly from the first major surface 18. Each protrusion 34 further includes a crest portion 36. Crest portions 36 extend along the angular length for a selected angular distance around the angular section 14.

In a preferred embodiment of terminal 10, all the crest portions 36 define angular segments of a common circumference interrupted and divided into portions by slots 26. All of the respective crest portions 36 are disposed substantially in a common plane and define an array of first contact surfaces comprising a contact interface 38 for electrical engagement with a common conductive surface 62 of first electrical article 60, as best seen in FIG. 5. For purposes of illustrating the invention, second connecting portion 48 for connecting to a second electrical article is shown as a barrel member for terminating to an electrical wire member. It is to be understood that the second electrical article is not to be limited to a conductive wire and that the second connecting portion of terminals made in accordance with the invention will have a configuration that is suitable for electrical engagement with the second electrical article.

Figure 1:
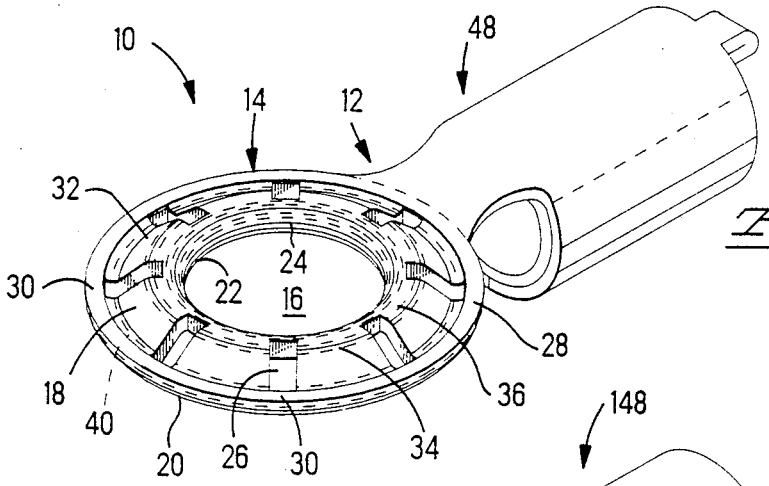
FIG. 1 is a perspective view of an electrical terminal made in accordance with the present invention.

FIG. 5 shows electrical terminal member 10 of FIG. 1 electrically engaged with conductive surface 62 on a first electrical article, shown representatively as circuit board 60. Terminal 10 is mounted to circuit board 60 by fastening means 50 comprising bolt and nut members 56, 58 respectively. Fastening means 50 is further shown being used with first and second washers 52, 54 respectively. It is to be understood that other types of fastening means as known in the art, such as a rivet, may also be used. As can be seen in FIGS. 1 and 5, annular section 14 has a configuration essentially equivalent to that of a Belleville washer and therefore has a sinusoidal cross section. As best seen in FIG. 5, second major surface 20 includes protrusion 40, which extends outwardly from surface 20 in a direction opposite to that of protrusion 34. Protrusion 40 includes an array of surface portions 42, which are disposed substantially in a common plane and are engagable by biasing means shown in FIG. 5 as first washer 52, which is held against surface portions 42 by fastening means 50 when terminal 10 is secured to circuit board 60. Owing to the Belleville washer shape of the first contact section of terminal 10 of FIG. 5, both the first and second washers 52, 54 are preferably flat members. There is no need to use a further locking washer when using the terminal 10 of FIG. 1. As torque is applied to bolt 56, pressure is applied to biasing means 52 and surface portions 42 thereby compressing spring sections 32 and establishing contact normal force between circuit board 60 and first contact surfaces at the contact interface 38. The increase in pressure and concomitant compression of spring members 32 causing a wiping action between crest portions 36 and the conductive surface 62 on circuit board 60 to ensure electrical connection therewith. Each one of the plurality of spring sections 32 provides a separate electrical path thus generating a plurality of electrical paths in parallel between first electrical article or circuit board 60 and a second electrical article, shown as conductor wire 70 in FIG. 7, upon terminal 10 being connected to the respective electrical articles and thereby decreasing the resistance of the interface.

Figure 2:
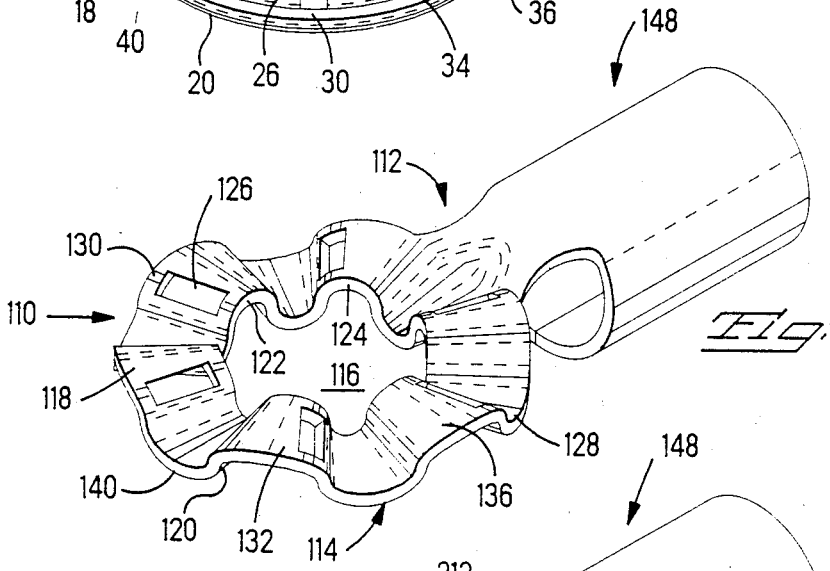
FIG. 2 is a perspective view of an alternative embodiment of an electrical terminal made in accordance with the invention.

FIG. 2 shows an alternative embodiment 110 of an electrical terminal member having first connecting portion 112 including annular section 114 and second connecting portion 148. Annular section 114 has a centrally disposed fastener receiving aperture 116 extending from a first major surface to a second major surface 118, 120 respectively. Annular section 114 has an inner edge 122 adjacent the fastener receiving aperture 116 and an outer edge 128 extending circumferentially therearound. A plurality of slots 126 are spaced around annular section 114, the slots 126 extending between an integral strap section 124 along the inner edge 122 and a second integral strap section 130 along outer edge 128. Annular section 114 is essentially wave shaped with slots 126 dividing section 114 into a plurality of waves having crest portions 136 extending radially outwardly from fastener receiving aperture 116. In this embodiment, terminal 110 includes a plurality of compliant beam portions 132 that extend along a selected distance around the annular circumference of annular member 114, each compliant beam section 132 being essentially separated by respective slot members 126.

Figure 6:
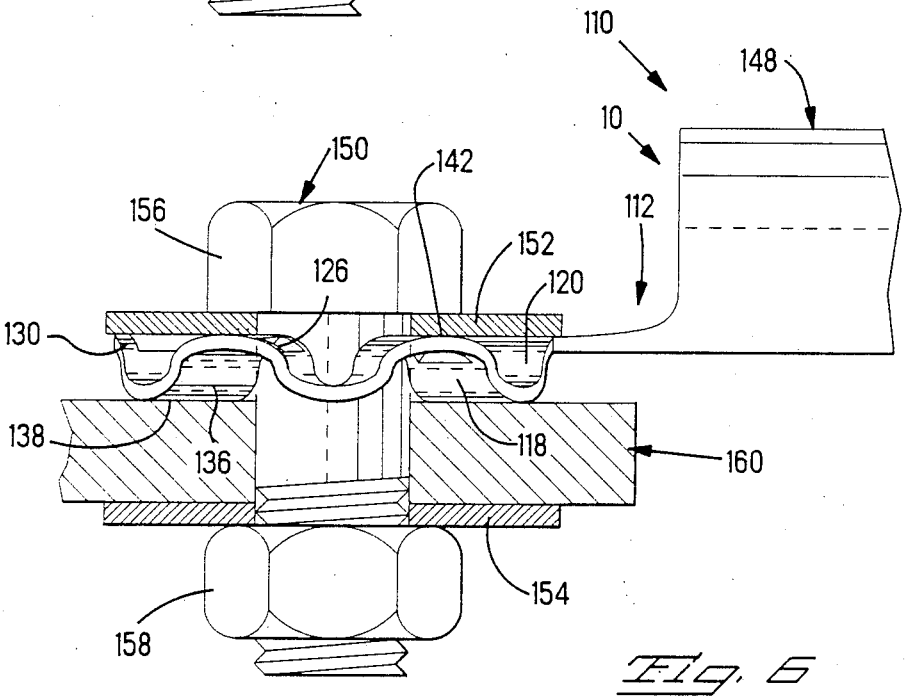
FIG. 6 is a fragmentary cross section view of terminal of FIG. 2 mounted to a first electrical article.

FIG. 6 illustrates the use of terminal member of FIG. 2 interconnecting a first electrical article shown as conductive bus bar member 160 to a second electrical article (not shown). Terminal member 110 is mounted to bus bar member 160 by fastening means 150 in essentially the same manner as previously described for terminal 10. As can be seen from FIG. 6 the first washer 152 exerts pressure on the wave shaped first connecting portion 112 at contact surfaces 142 on second major surface 120 forcing surfaces 136 into engagement against the bus bar member 160. For this embodiment, one of the washers either 152 or 154 needs to be a locking washer. Owing to the wave nature of the first connecting portion 112, it is preferable to use an essentially flat washer between bolt 156 and terminal 110 layer but a lock washer such as a Belleville washer between the nut 158 and the lower surface of bus bar member 160. These washers however are not used as actual current carrying member but are used to maintain an essentially constant normal force despite temperature fluctuations that occur in the assembly when electrical load is applied.

Figure 3:
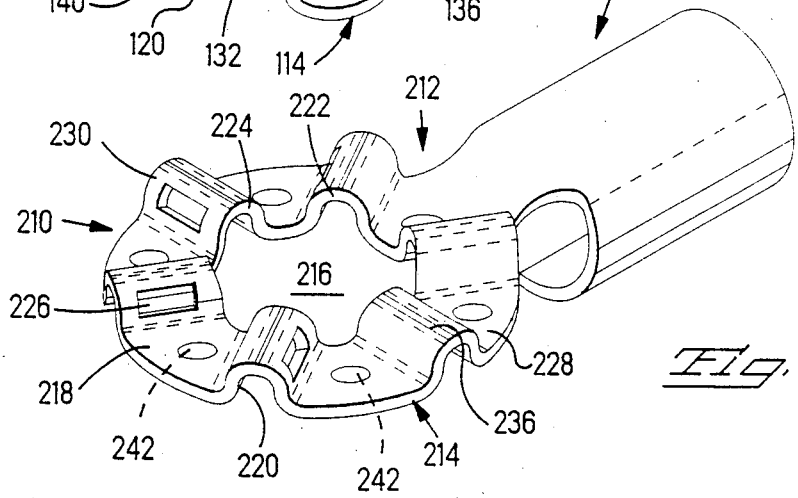
FIG. 3 is a perspective view of a further alternative embodiment of an electrical terminal made in accordance with this invention.

A further alternative embodiment 210 of the terminal made in accordance with the invention is illustarated in FIG. 3. The first contact surfaces 236 of this terminal are similar to that of terminal 110 of FIG. 2 in that the first major surface 218 of this terminal has the plurality of wave shaped portions having contact surfaces that extend radially outwardly from the center fastener receiving aperture 216. The second major surface 220 of the terminal includes a plurality of outwardly extending flattened wave-type sections, each having a respective dimple member 242. Dimple members 242 are compressible under pressure to comprise a plurality of contact surfaces 242 between the terminal and a biasing means such as a washer or a common conductive surface of a first electrical article.

FIGS. 4 and 4A illustrate further embodiments 310, 410 of a terminal made in accordance with the invention. In the embodiment of FIG. 4, first connecting portion 312 comprises a plurality of compliant beam portions 332 which are interconnected only at one end instead of two as are the beams in the embodiments shown in FIGS. 1–3. FIG. 4A illustrates a terminal embodiment similar to that of FIG. 4 but slots 426 are configured to keep beams 432 at an essentially constant width as they extend radially outwardly from inner strap portions 424 adjacent fastening aperture 416. While FIGS. 4 and 4A show the beams 332, 432 interconnected at the inner edge 322, 422 of the fastener receiving aperture 316, 416 and not at the outer edge 328, 428, it is to be understood that beams 332, 432 could be connected at the outer edge 328, 428 instead of the inner edge 322, 422 respectively.

In accordance with the invention terminal members 10, 110, 210, 310 and 410 provide a plurality of contact sections essentially equivalent to compliant beam portions to provide a plurality of contact points for interconnecting a terminal with a first electrical article. The resistance at the contact interface of a particular interconnection can be varied by changing the number of slots in the annular body portion and thereby the number of spring arms in the corresponding terminal member. The greater the number of parallel electrical paths, the lower the resistance is through the terminal. Since each one of the sections provides a contact surface, sufficient torque needs to be applied only to bring the sections into physical contact and electrical engagement with the opposed surface. It should also be recognized that the terminal embodiments wherein both ends of the contact beams are joined by respective strap sections essentially act as a single spring member having a plurality of sections thus providing for a more equalized application of force than may be achievable with the plurality of separate spring arm members.

As can be appreciated, the Belleville washer type structure of terminal 10 can be subdivided into a greater number of contact sections than the wave shaped contact sections of terminals 110 and 210 respectively. By increasing the number of contact sections of terminal 10, the normal force required to maintain electrical engagement between the terminal and a first electrical article is reduced thus making the terminal configuration of FIG. 1 particularly suitable for use with circuit boards without causing distortion of the board. It is to be understood however that all of the terminal members of the present invention may be used with electrical articles such as bus bars and circuit board members. In determining the number of sections into which the first connecting portion is to be subdivided, it is necessary to know the desired electrical characteristics of the contact interface for the particular electrical system being designed. The use of multiple contact points at regular intervals separated by slots in a radial pattern provides substantially independent current paths. The pattern allows more accurate determination of the resistance at the interface than is possible in the prior art.

Terminals made in accordance with the invention are suitable for use with signal and power systems. When used in signal systems, the terminal can be made of materials such as phosphor bronze, and the like. When used with power systems, stock thicknesses generally are in the range of 0.020 to 0.060 inches. The thickness of the stock and the conductive material used for the stock will depend upon the amount of load placed through the terminal.

Preferably the terminals made in accordance with this invention are stamped and form members from the selected stocked material. When these terminals are used in power connections and connected to wire member, it is often desirable to maintain the crimpability of the wire barrel portion by providing a double barrel section as shown in FIGS. 1 and 5. FIG. 7 is a cross sectional view of second electrical article, shown as conductive wire 70, crimped within double barrel 48. Further details about the construction of and advantages of the crimpable double barrel power terminals are disclosed in U.S. patent application Ser. No. 07/359,196, filed concomitantly herewith, entitled "Method for Making a Wire Barrel Terminal".

In designing the mating portion of a terminal to be interconnected to a flat member by means of a bolt, it is most desirable to have a plurality of contact paths to a plurality of contact points between a connecting member and an electrical article. This is particularly important when terminals are used for power distribution systems where high current is being conducted between the first and second electrical articles. The multiple contact points provide an equalized flow of current through the terminal. In addition the multiple contact points made in accordance with the invention have a low resistance through the interface.

As can be seen from the previous description the current invention replaces typical flat ring type members that generate a single circular line of contact between mating surfaces with multiple contact points provided in a random pattern. The multiple electrically parallel beam configuration allows the amount of resistance to be determined and in addition the forces needed to accurately achieve the desired amount of contact area. The present design also permits the use of thinner and more flexible materials for carrying an equivalent amount of current than was hereto possible. Since the amount of contact area can be accurately determined and the constriction resistance of the interface minimized, and the normal force required to effect interconnection reduced, it is no longer necessary to use fixed stocked materials that are sufficient to withstand high normal force previously to effect a sufficient contact area through the interface. The present invention also provides a means to design a terminal which is sized to carry a specified amount of current. The present invention provides a means whereby materials having strong spring characteristics may be used to effect a plurality of contact points in a cost effective manner.

It is thought that the electrical terminals of the present invention and many of its attendant advantages will be understood from the foregoing description. It will be apparent that various changes may be made in the form, construction and arrangement of the parts thereof without departing from the spirit or scope of the invention or sacrificing all its material advantages. The form herein described is merely a preferred or exemplary embodiment thereof.

We claim:

1. An improved electrical terminal suitable for use in connecting a first electrical article to a second electrical article comprising:

first and second connecting portions at opposed ends of a terminal member for electrically engaging first and second electrical articles respectively;

said first connecting portion comprising an annular section having a centrally disposed fastener receiving aperture extending therethrough from a first major surface to an opposed second major surface, said annular section having an inner edge adjacent said fastener receiving aperture and an outer edge extending circumferentially therearound;

said annular section further including a plurality of slots spaced therearound each extending from at least one integral strap section along one of said inner edge and said outer edge, said slots defining therebetween respective spring sections in an annular array, each of said spring sections at least including a respective protrusion extending outwardly from said first major surface, each said respective protrusion having a crest portion, all of said respective crest portions being disposed substantially in a common plane and defining an array of first contact surfaces comprising a contact interface for electrical engagement with a common conductive surface of said first electrical article upon being fastened thereto by fastening means; and said second major surface at least including an array of surface portions engagable by a biasing means held thereagainst by said fastening means securing said first connecting portion of said first terminal member to said first electrical article, thereby compressing said spring sections and establishing contact normal force between said first electrical article and said first contact surfaces; whereby a plurality of electrical paths in parallel are generated between said first electrical article and said second electrical article upon said terminal being connected to said first and second electrical articles and biasedly held therebetween, thereby minimizing the electrical resistance at the contact interface.

2. An electrical assembly comprising first and second electrical articles electrically interconnected by means of the electrical terminal of claim 1.

3. The electrical terminal of claim 1 wherein said spring sections of said annular section extend radially outwardly from said inner strap section.

4. The improved electrical terminal of claim 1 further including a second integral section along the other of said inner and said outer edge of said annular section.

5. The electrical terminal of claim 4 wherein said spring sections of said annular section extend radially outwardly from said inner strap section.

6. The electrical terminal of claim 4 wherein said spring sections extend along a selected distance around the annular circumference of said annular section.

7. An electrical assembly comprising:

a first electrical article having a conductive surface thereon;

a second electrical article; and an electrical terminal having first and second portions at opposed ends of a terminal member for electrically engaging first and second electrical articles respectively;

said first connecting portion comprising an annular section having a centrally disposed fastener receiving aperture extending therethrough from a first major surface to an opposed second major surface, said annular section having an inner edge adjacent said fastener receiving aperture and an outer edge extending circumferentially therearound;

said annular section further including a plurality of slots spaced therearound each extending from at least one integral strap section along one of said inner edge and said outer edge, said slots defining therebetween respective spring sections in an annular array, each of said spring sections at least including a respective protrusion extending outwardly from said first major surface, each said respective protrusion having a crest portion, all of said respective crest portions being disposed substantially in a common plane and defining an array of first contact surfaces comprising a contact interface for electrical engagement with a common conductive surface of said first electrical article upon being fastened thereto by fastening means; and said second major surface at least including an array of surface portions engageable by a biasing means held thereagainst by said fastening means securing said first connecting portion of said first terminal member to said first electrical article, thereby compressing said spring sections and establishing contact normal force between said first electrical article and said first contact surfaces; whereby a plurality of electrical paths in parallel are generated between said first electrical article and said second electrical article upon said terminal being connected to said first and second electrical articles and biasedly held therebetween, thereby minimizing the electrical resistance at the contact interface.

8. The electrical assembly of claim 7 wherein said spring sections of said annular section extend radially outwardly from said inner strap section.

9. The electrical assembly of claim 7 wherein said first electrical article is a circuit board.

10. The electrical assembly of claim 7 wherein said first electrical article is a metal member.

11. The electrical assembly of claim 7 wherein said annular section of said first connecting portion further includes a second integral section along the other of said inner and said outer edge.

12. The electrical assembly of claim 11 wherein said spring sections of said annular section extend radially outwardly from said inner strap section.

13. The electrical assembly of claim 11 wherein said spring sections extend along a selected distance around the annular circumference of said annular section.

14. The electrical assembly of claim 11 wherein said first electrical article is a circuit board.

15. The electrical assembly of claim 11 wherein said first electrical article is a metal member.

* * * * *